US006760921B1

(12) United States Patent
Simmons

(10) Patent No.: US 6,760,921 B1
(45) Date of Patent: Jul. 13, 2004

(54) UNITARY BEACH TOWEL AND PONCHO WITH HOOD

(76) Inventor: Jason Simmons, 611 Monroe Turnpike, Monroe, CT (US) 06468

( * ) Notice: Subject to any disclaimer, the term of this patent is extended or adjusted under 35 U.S.C. 154(b) by 0 days.

(21) Appl. No.: 10/424,083

(22) Filed: Apr. 25, 2003

(51) Int. Cl.[7] ..... A41D 3/02
(52) U.S. Cl. ..... 2/84
(58) Field of Search ..... 2/84, 88, 69, 46, 2/49.4, 102, 103, 104, 106, 115, 247, 69.5; 383/4

(56) References Cited

U.S. PATENT DOCUMENTS

| | | | | | |
|---|---|---|---|---|---|
| 4,370,755 | A | * | 2/1983 | Crumby | 2/88 |
| D336,356 | S | | 6/1993 | Shakir | |
| D355,096 | S | | 2/1995 | Lang | |
| 5,459,881 | A | | 10/1995 | Fagan et al. | |
| D365,193 | S | | 12/1995 | Dodd, Jr. | |
| 5,495,621 | A | * | 3/1996 | Kibbee | 2/2.5 |
| 5,664,258 | A | * | 9/1997 | Harris | 2/84 |
| 5,720,043 | A | | 2/1998 | White, Sr. | |
| 5,884,331 | A | * | 3/1999 | Barajas | 2/69 |
| 5,901,375 | A | * | 5/1999 | Davis | 2/84 |
| D414,067 | S | | 9/1999 | Wickline et al. | |
| D429,059 | S | | 8/2000 | Simmons | |
| 6,243,873 | B1 | * | 6/2001 | Aliff | 2/88 |
| 6,341,379 | B1 | * | 1/2002 | Kokus | 2/89 |
| D465,317 | S | | 11/2002 | Darling | |

* cited by examiner

*Primary Examiner*—Tejash Patel
(74) *Attorney, Agent, or Firm*—Proteus Patent Practice LLC; Henry E. Auer

(57) ABSTRACT

The present invention provides a unitary moisture-absorbing and element-protective article that includes a poncho-shaped sheet and hood nondetachably connected to the sheet. The poncho-shaped sheet includes at least one layer, and has an opening that permits the head and neck of the person wearing the article to extend therethrough. The sheet is drapable over the wearer in a standing position, and rests on the shoulders. The hood is shaped to cover the head, neck and hair of the person when positioned thereon. When not worn, an important attribute of the article is that it may be opened to a flat covering that, when disposed upon the surface of the ground, is suitable for a person to recline thereon. The invention further provides methods of removing water from the head, neck, body, and/or the hair of a person, of shielding the body of a person from exposure to the elements, and of preventing direct contact of the body of a person with a surface of the ground that includes disposing the article of the invention on the surface.

19 Claims, 3 Drawing Sheets

A

B

UNITARY BEACH TOWEL AND PONCHO WITH HOOD

FIELD OF THE INVENTION

This invention relates to a unitary multipurpose garment for use on a beach or shore of a body of water. The uses include absorbing or blotting water from the body of the wearer, shielding the body of the wearer from the elements and providing a ground covering on the beach or shore. More specifically, the invention relates to a unitary combination beach towel and poncho-shaped garment with an integral hood.

BACKGROUND OF THE INVENTION

A visitor to a beach, lakefront, riverfront, oceanfront or similar area bordering a recreational body of water has several needs. These include 1) a need to have a toweling means available to absorb moisture from the skin of the head, neck and body, and the hair, after immersion in the water, 2) a need to protect the head, neck, body and hair against exposure to atmospheric elements such as sunshine, wind, or rain, and 3) a need for a cover to spread upon the surface of the ground to serve as an interface between the body of a person and the surface when the person sits, reclines or lies on the surface.

Products currently available include various embodiments of items such as a combination beach towel and poncho, as well as a combination hat with poncho wherein the poncho may be folded into a compartment of the hat when not used, and a poncho-coat combination.

It is believed that none of the items currently known in the field provide features that include 1) providing a toweling means available to absorb moisture from the skin of the head, neck and body, and the hair, after immersion in the water, 2) protecting the head, neck, body and hair against exposure to atmospheric elements such as sunshine, wind, or rain; and 3) providing a cover to spread upon the surface of the ground to serve as an interface between the body of a person and the surface when the person sits, reclines or lies on the surface. Thus there remains a need for an article that provides these and related attributes. The present invention addresses these needs.

SUMMARY OF THE INVENTION

In a first aspect the present invention provides a unitary moisture-absorbing and element-protective article that includes a poncho-shaped sheet and hood nondetachably connected to the sheet. The poncho-shaped sheet includes at least one layer, and has an opening, having a front edge and a back edge, that is approximately centered on the sheet. The opening permits the head and neck of the person wearing the article to extend therethrough. The sheet is drapable over the wearer in a standing position, and rests on the shoulders. It furthermore has a front with front borders and a back with back borders, with reference to the body of the person, and further has an interior surface and an exterior surface with reference to the body of the person. The hood is shaped to cover the head, neck and hair of the person when positioned thereon. It is constituted of at least one layer, connected nondetachably to the sheet at or near the back edge of the opening thereof. The hood further has an interior surface and an exterior surface with reference to the body of the person; at least the interior surface of the sheet and the interior surface of the hood are comprised of a moisture-absorbing fabric.

In an important embodiment of the article each of the sheet and the hood consist of one layer of fabric or material. In another advantageous embodiment the moisture-absorbing fabric used in the article also provides the exterior surface of the sheet and the exterior surface of the hood. In still another significant embodiment, each of the sheet and the hood of the article include a plurality of layers, such that a layer closest to the person is an innermost layer and a layer furthest from the person is an outermost layer. In still a further significant multi-layer embodiment the innermost layer of each of the sheet and the hood has a moisture-absorbing fabric, and the outermost layer of each of the sheet and the hood is made of a water-repellent material or a wind-repellent material or both, or a moisture-absorbing fabric.

In yet another important embodiment, the article includes means for securing the article about the body of the person wearing it In a further important embodiment the securing means may be chosen from among loops to accommodate a body-wrapping belt, mutually matable fasteners disposed at the front borders and the back borders of the sheet, and mutually matable hook and pile materials disposed at the front borders and the back borders of the sheet. In an additional advantageous embodiment, the article includes one or more pockets.

When not being worn, an important attribute of the article is that it may be opened to a flat covering that, when disposed upon the surface of the ground, is suitable for a person to recline thereon.

In an additional aspect the invention provides a method of removing water from the head, neck, body, and/or the hair of a person that includes donning the article of the invention and bringing the interior surface thereof into contact with the head, neck, body, and/or the hair.

In a further aspect, the invention provides a method of shielding the body of a person from exposure to the elements that includes donning the article of the invention, and firer includes covering the head and neck with the hood.

In yet an additional aspect, the invention provides a method of preventing direct contact of the body of a person with a surface of the ground that includes disposing the article of the invention on the surface.

DETAILED DESCRIPTION OF THE INVENTION

The present invention provides a unitary moisture-absorbing and element-protective article wearable by a person that is also disposable upon a surface of the ground to serve as an interface between the body of a person and the ground surface. As used herein, "unitary" relates to being a single article not capable of being separated during use into smaller components. The combination article disclosed herein provides a toweling means available on an interior surface adjacent the skin of the wearer to absorb moisture from the skin of the head, neck, body and hair after immersion in the water, protects the head, neck, body and hair against exposure to atmospheric elements such as sunshine, wind, or rain, and provides a cover to spread upon the surface of the ground to serve as an interface between the body of a person and the surface of the ground when the person sits, reclines or lies on the ground.

Figure 1:
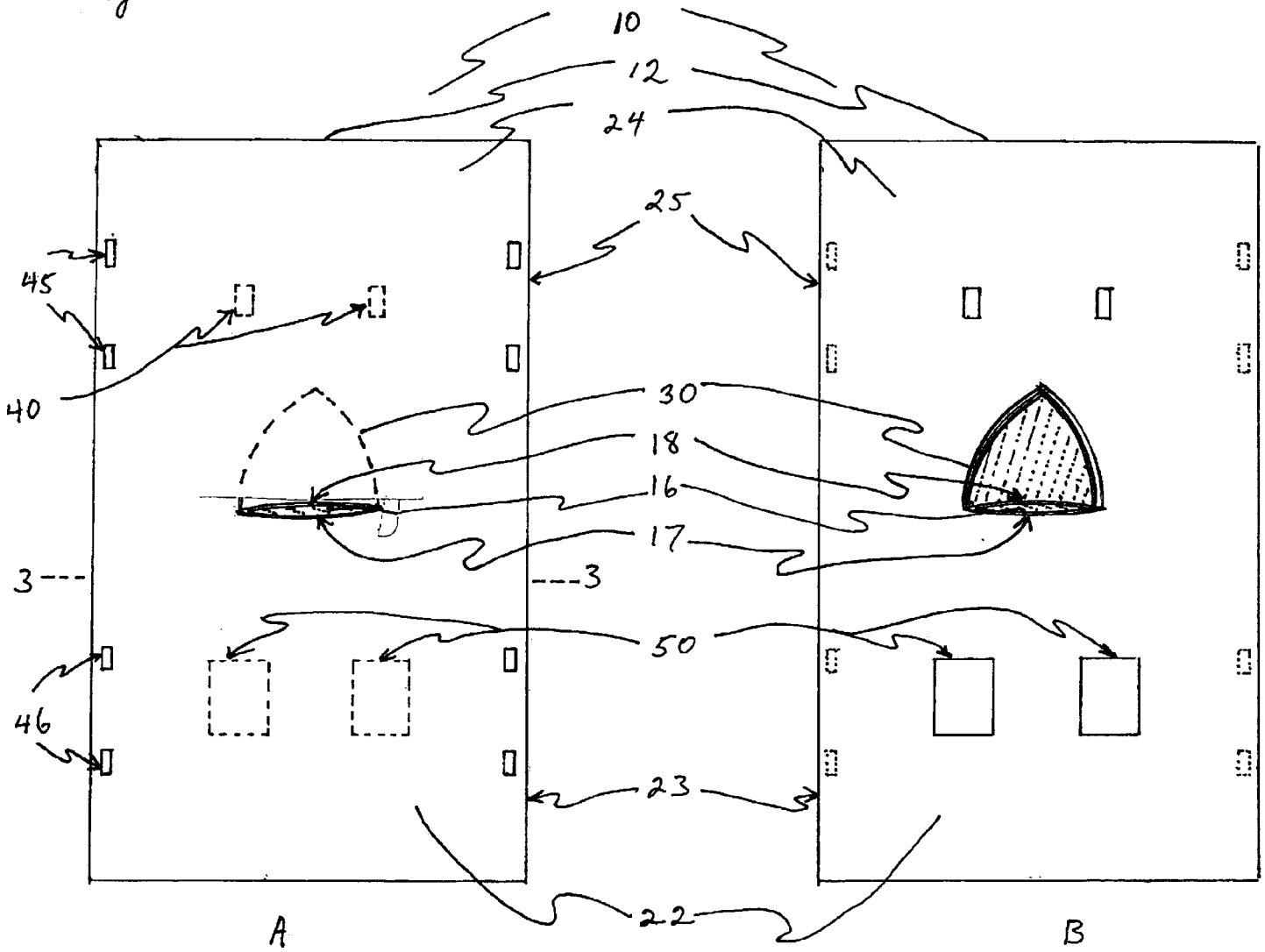
FIG. 1 provides a schematic representation of an article of the invention. Panel A, interior surface; Panel B, exterior surface.

The present invention provides a unitary moisture-absorbing and element-protective article, shown in FIG. 1 generally at 10, wearable by a person and disposable upon a surface of the ground. The article comprises a poncho-shaped sheet 12 and a hood 30 that is shaped to cover the head, neck and hair of the person when positioned thereon, connected permanently, i.e., nondetachably, to the sheet at or near the back edge of the opening thereof. As used herein "poncho-shaped" relates to any article having an opening for the head and neck and worn by draping over the shoulders of a person and providing a covering for much or all of the body of the person. By way of nonlimiting example, a poncho-shaped sheet covers at least the shoulders, arms and torso of the person, or covers at least the shoulders, arms, torso and hips of the person, or covers at least the shoulders, arms, torso hips and upper legs of the person. As used herein "permanently" or nondetachably", and similar terms, relate to the property that the hood is fastened or bonded to the sheet in such a way that, during ordinary use, it is not separable or detachable therefrom.

The poncho-shaped sheet 12 includes at least one layer drapable over a person in a standing position. It furthermore includes an opening 16 having a front edge 17 and a back edge 18 and being approximately centered on the shape of the poncho. The opening 16 permits the head and neck of a person wearing the article to extend through it. The poncho-shaped sheet has a front portion, generally at 22, with reference to the body of the person, with front borders 23 along the sides of the front portion 22, and a back portion, generally at 24, with reference to the body of the person, with back borders 25 along the sides of the back portion. The poncho-shaped article further has an interior surface (viewed in Panel A of FIG. 1) and an exterior surface (viewed in Panel B of FIG. 1) with reference to the body of the person. As noted the article also includes a hood 30 shaped to cover the head, neck and hair of a person wearing the article when positioned thereon. The hood is connected in a nondetachable fashion, to the sheet 10 at or near the back edge 18 of the opening 16 thereof. The hood is comprised of at least one layer. The hood has an interior surface 31 with reference to the body of the person and an exterior surface 32 (See FIG. 4) with reference to the body of the person. In general, at least the interior surface of the sheet (FIG. 1, Panel A) and the interior surface 31 of the hood are comprised of a moisture-absorbing fabric.

In important embodiments the article includes means for securing the article about the body of a person wearing the article. Securing the article helps protect against the elements, including wind and rain, and has the effect of keeping the article from flapping in the wind or interfering with the stride of the wearer. In one nonlimiting embodiment, still referring to FIG. 1, the securing means may be loops 40 to accommodate a body-wrapping belt, for example at a position on the article that places a belt, when present, near the waistline of the person. In this case a belt is passed through the loops and drawn around any flaps and folds in the article to draw the article about the body of the person wearing it. A belt is shown at 41 in FIG. 4, Panels A and B. In a second nonlimiting embodiment shown in FIG. 1 the securing means may be mutually matable fasteners 45, 46 disposed at the front borders 23 and the back borders 25, respectively, of the sheet. Such mutually matable fasteners include, by way of nonlimiting example, snap fasteners with mated male and female components, mutually matable hook and pile fabrics, buttons and buttonholes, and metal hooks with matable metal receiving loops.

Figure 4:
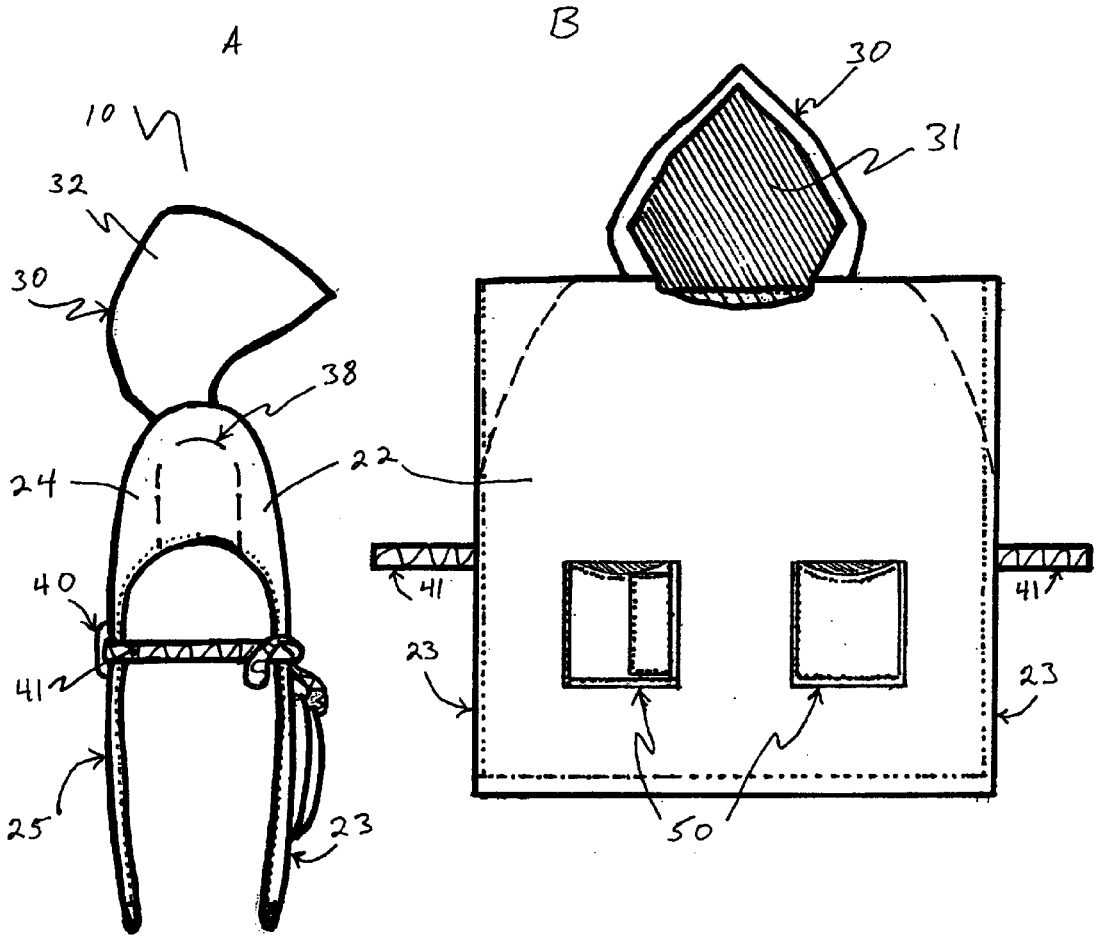
FIG. 4 presents a schematic representation of an embodiment of the invention. Panel A, side view; Panel B, front view.

In a further important embodiment, one or more pockets 50 may be disposed on a surface of the article (examples are shown FIG. 1 and FIG. 4, Panel B).

Figure 2:
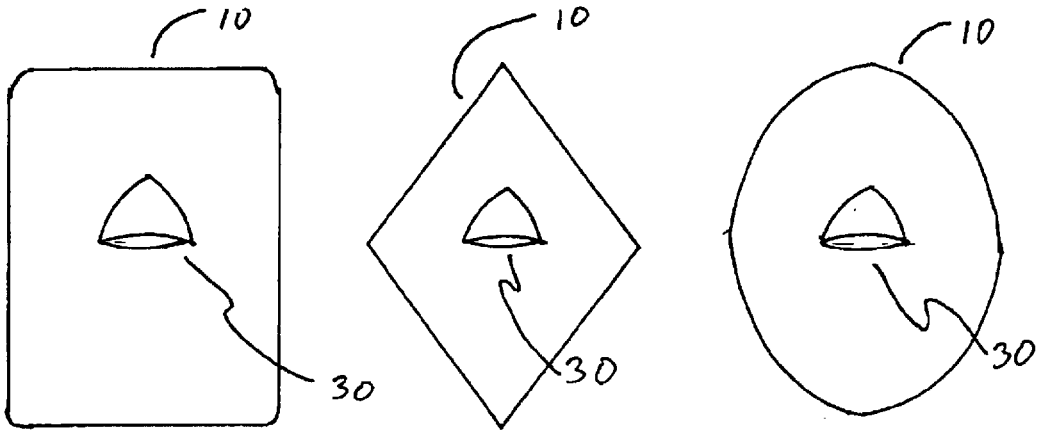
FIG. 2 presents representations of certain shapes of the article of the invention.

FIG. 2 shows various nonlimiting embodiments of the article 10 of the invention having different shapes. In general the article may have any shape that preserves the ability to wear it such that the head and neck of the wearer protrudes through the opening 16, has a nondetachable hood 30 that covers the head, neck and hair of the wearer, and is capable of being spread on the surface of the ground.

Figure 3:
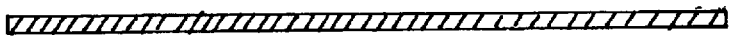
FIG. 3 presents schematic representations of cross sections of certain embodiments of the invention, taken at the dashed line 3 in FIG. 1, Panel A.
Figure 3:
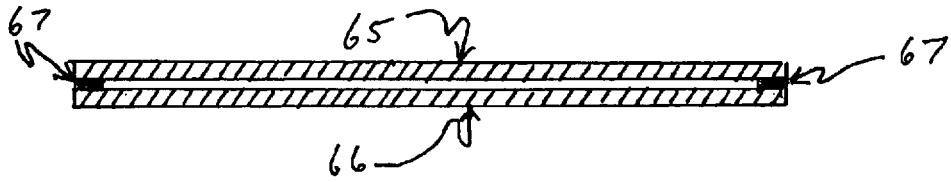

FIG. 3 shows a cross section of the article 10 in two nonlimiting embodiments, taken at any exemplary position such as that shown by dashed lines 3 in FIG. 1, Panel A. In FIG. 3, Panel A shows an embodiment having a single layer of fabric or material with an exterior surface 61 with reference to the body of the wearer, and an interior surface 62 with reference to the body of the wearer. In many embodiments of the invention the hood 30 is made of the same or similar fabric or material as the poncho shaped sheet 12. The fabric or material is such that at least the interior surface 62 is or has a moisture-absorbing fabric. The exterior surface 61 may be manufactured to have the same or any different composition.

In FIG. 3, Panel B a second embodiment of the article 10 is shown having two layers of fabric or material, an interior layer 66 with reference to the body of the wearer that is innermost, and an exterior layer 65 with respect to the body of the wearer that is outermost. The two layers are joined or bonded to each other at least at the edges of the article, as shown at 67. In many embodiments of the invention the hood 30 has the same layers as the poncho shaped sheet 12. In the embodiment of FIG. 3, Panel B, and in still further embodiments comprising more than two layers of fabric or material, the fabric or material is such that at least the inner surface of the innermost layer 66 is or has a moisture-absorbing fabric. The outer surface of the outermost layer 65 may be of the same or any different composition. Nonlimiting examples of various materials include a water-repellent material, a wind-repellent material, a material having both water-repellent and wind-repellent properties, or a moisture-absorbing fabric.

A further representation of an embodiment of the article 10 of the invention is presented in FIG. 4, Panels A and B. Some of the features already discussed are identified thereon by their numerical references. In addition, the approximate drape line over the shoulders of the wearer is identified as 38.

In use, a bather or swimmer removes water or moisture from his or her head, neck and body, and hair, by donning an article 10 of the invention and bringing its interior surface into contact with the skin. The moisture-absorbing ac at that surface removes water or moisture adhering to the head, neck and body, and hair, and helps dry them.

Similarly, a person visiting a beach, lakefront, riverfront, oceanfront or similar area bordering a recreational body of water will shield his or her body from exposure to the elements of the weather by donning an article 10 of the invention, preferably including raising the hood to cover the head, neck and body, and the hair. In this way the visitor is protected from sun, wind, and blowing dust or objects carried in the air. Additionally, in those embodiments of the article having an exterior surface that is water-repellent, donning the article will shield the wearer from rain, for in certain conditions the weather can change from sunny or fair to rainy relatively quickly.

The article of the invention is a multi-use article, intended additionally to serve as a beach towel or similar ground covering when one visits a beach, lakefront, riverfront, oceanfront or similar area bordering a recreational body of water. In this use, a person spreads or disposes the article surface of the ground. This use prevents direct contact of the body of the person with the surface, and provides a clean area on which to recline, and place other objects such as packs, sacks and beach chairs.

The present invention is not limited by particular embodiments described in the specification above. The present invention encompasses all the various articles and methods that are presented in the claims below, and all equivalents thereto.

I claim:

1. A unitary moisture-absorbing and element-protective article comprising a) a poncho-shaped sheet comprising at least one layer, the sheet including an opening having a front edge and a back edge and being approximately centered on the sheet, the opening permitting the head and neck of the person to extend therethrough, wherein said sheet is drapable over a person in a standing position and has a front with front borders and a back with back borders, with reference to the body of the person, and further having an interior surface and an exterior sure with reference to the body of the person; and b) a hood shaped to cover the head, neck and hair of the person when positioned thereon, comprising at least one layer, connected nondetachably to the sheet at or near the back edge of the opening thereof, the hood having an interior surface and an exterior surface with reference to the body of the person;

wherein at least the interior surface of the sheet and the interior surface of the hood comprise a moisture-absorbing fabric.

2. The article described in claim 1 wherein the article opens to a flat covering when disposed upon the surface of the ground suitable for a person to recline thereon.

3. The article described in claim 1 wherein each of the sheet and the hood consist of one layer.

4. The article described in claim 3 wherein the moisture-absorbing fabric further provides the exterior surface of the sheet and the exterior surface of the hood.

5. The article described in claim 1 wherein each of the sheet and the hood comprise a plurality of layers, wherein a layer closest to the person is an innermost layer and a layer furthest from the person is an outermost layer.

6. The article described in claim 5 wherein the innermost layer of each of the sheet and the hood comprises a moisture-absorbing fabric.

7. The article described in claim 5 wherein the outermost layer of each of the sheet and the hood comprises a water-repellent material or a wind-repellent material or both, or a moisture-absorbing fabric.

8. The article described in claim 1 further comprising means for securing the article about the body of the person.

9. The article described in claim 8 wherein the securing means is chosen from the group consisting of loops to accommodate a body-wrapping belt, mutually matable fasteners disposed at the front borders and the back borders of the sheet, and mutually matable hook and pile materials disposed at the front borders and the back borders of the sheet.

10. The article described in claim 1 further comprising a pocket.

11. The article described in claim 5 further comprising a pocket disposed on an exterior surface of the outermost layer thereof.

12. A method of removing water from the head, neck, body, and/or the hair of a person comprising donning the article described in claim 1 and bringing the interior surface thereof into contact with the skin and/or the hair.

13. A method of removing water from the head, neck, body, and/or the hair of a person comprising donning the article described in claim 5 and bringing the interior surface thereof into contact with the skin and/or the hair.

14. A method of shielding the body of a person from exposure to the elements comprising donning the article described in claim 1.

15. A method of shielding the body of a person from exposure to the elements comprising donning the article described in claim 5.

16. The method described in claim 14 further comprising covering the head and neck of the person with the hood.

17. A method of preventing direct contact of the body of a person with a surface of the ground comprising disposing the article described in claim 1 on the surface.

18. A method of preventing direct contact of the body of a person with a surface of the ground comprising disposing the article described in claim 5 on the surface.

19. The article described in claim 4 wherein the poncho-shaped sheet consists of one layer, the hood consists of one layer, and wherein the interior surface of the sheet, the interior surface of the hood, the exterior surface of the sheet and the exterior surface of the hood consist of a moisture-absorbing fabric.

* * * * *